US005336153A

United States Patent [19]

Chen

[11] Patent Number: 5,336,153

[45] Date of Patent: Aug. 9, 1994

[54] MULTIPURPOSE GYMNASTIC APPARATUS

[75] Inventor: Jack Chen, Taichung, Taiwan

[73] Assignee: Joong Chenn Industry Co., Ltd., Taichung, Taiwan

[21] Appl. No.: 15,515

[22] Filed: Feb. 9, 1993

[51] Int. Cl.[5] ..... A63B 21/00

[52] U.S. Cl. ..... 482/137; 482/99; 482/100

[58] Field of Search ..... 482/135, 136, 100, 137, 482/138, 97–99

[56] References Cited

U.S. PATENT DOCUMENTS

| | | | |
|---|---|---|---|
| 3,640,527 | 2/1972 | Proctor | 482/100 |
| 3,912,261 | 10/1975 | Lambert | 482/100 |
| 4,505,475 | 3/1985 | Olschansky et al. | 482/100 |
| 4,840,373 | 6/1989 | Maag | 482/100 |
| 4,844,456 | 7/1989 | Habing et al. | 482/100 |
| 5,120,289 | 6/1992 | Yu | 482/100 |

*Primary Examiner*—Richard J. Apley

*Assistant Examiner*—Jerome Donnelly

*Attorney, Agent, or Firm*—Browdy and Neimark

[57] ABSTRACT

A multipurpose gymnastic apparatus comprises a frame unit, a pulley unit, and a load carrying unit. The frame unit is composed of a ladder frame having a front end on which a dual-purpose pushing and rotating device is mounted, a chair set and a leg stretching device. The pulley unit comprises a plurality of independent ropes running through the pulleys and having free ends connected with the pushing and rotating device and the leg stretching device. The load carrying unit is capable of being lifted and lowered by the ropes. The pushing and rotating device comprises two wheel fitting members, two arresting pieces, and a protective rod. The ropes running on the two fitting members can be actuated by the two arresting pieces to permit a chest building exercise to be done while the ropes can be pressed against by the protective rod to permit an arm building exercise to be done.

2 Claims, 5 Drawing Sheets

MULTIPURPOSE GYMNASTIC APPARATUS

FIELD OF THE INVENTION

The present invention relates to a gymnastic apparatus, and more particularly to an improved multipurpose gymnastic apparatus.

BACKGROUND OF THE INVENTION

The multipurpose gymnastic apparatus of the prior art is mainly composed of a frame unit, a pulley unit, and a load carrying device. An arm building device is pivoted to the front end of an upper beam of a ladder frame of the frame unit while a chair unit is set up at the center of the upper beam. A leg-stretching device is pivoted to the front end of the chair unit. Located behind the ladder frame is a chest building device under which another chair unit is mounted. The pulley unit is mounted at the upper and the bottom portions of the frame unit. The load carrying device is disposed by the frame unit and can be raised by a rope running on the pulley unit.

The prior art multipurpose gymnastic apparatus described above has a body of great size and weight and therefore takes up two much of the space. With a view to overcoming the shortcomings of the prior art multipurpose gymnastic apparatus described above, there are recently new multipurpose gymnastic apparatus that are disclosed in the Taiwanese Patent Numbers 79214330 and 80206840. The apparatus disclosed in the Taiwanese Patent 79214330 is characterized in that its arm building device can be easily converted into a chest building device by unfastening the two bolts so as to keep the baffle and the lifting-pressing bar apart. The apparatus disclosed in the Taiwanese Patent 80206840 has a feature that its arm building device is converted into a chest building device by unfastening the elongate bolt out of the slot of the baffle. As a result, the overall size of the multipurpose gymnastic apparatus of the above-identified patents is effectively reduced. However, such improved multipurpose gymnastic apparatus as described above are still limited in that the conversion of the arm building device into the chest building device can not be done quickly and easily by the user.

SUMMARY OF THE INVENTION

It is therefore the primary objective of the present invention to provide a multipurpose gymnastic apparatus, which permits a user to do an arm building exercise or a chest building exercise without having to make any mechanical adjustment.

The foregoing objective of the present invention will be better understood by studying the following detailed description of a preferred embodiment of the present invention in conjunction with the drawings provided herewith.

DETAILED DESCRIPTION OF THE PREFERRED EMBODIMENT

Figure 1:
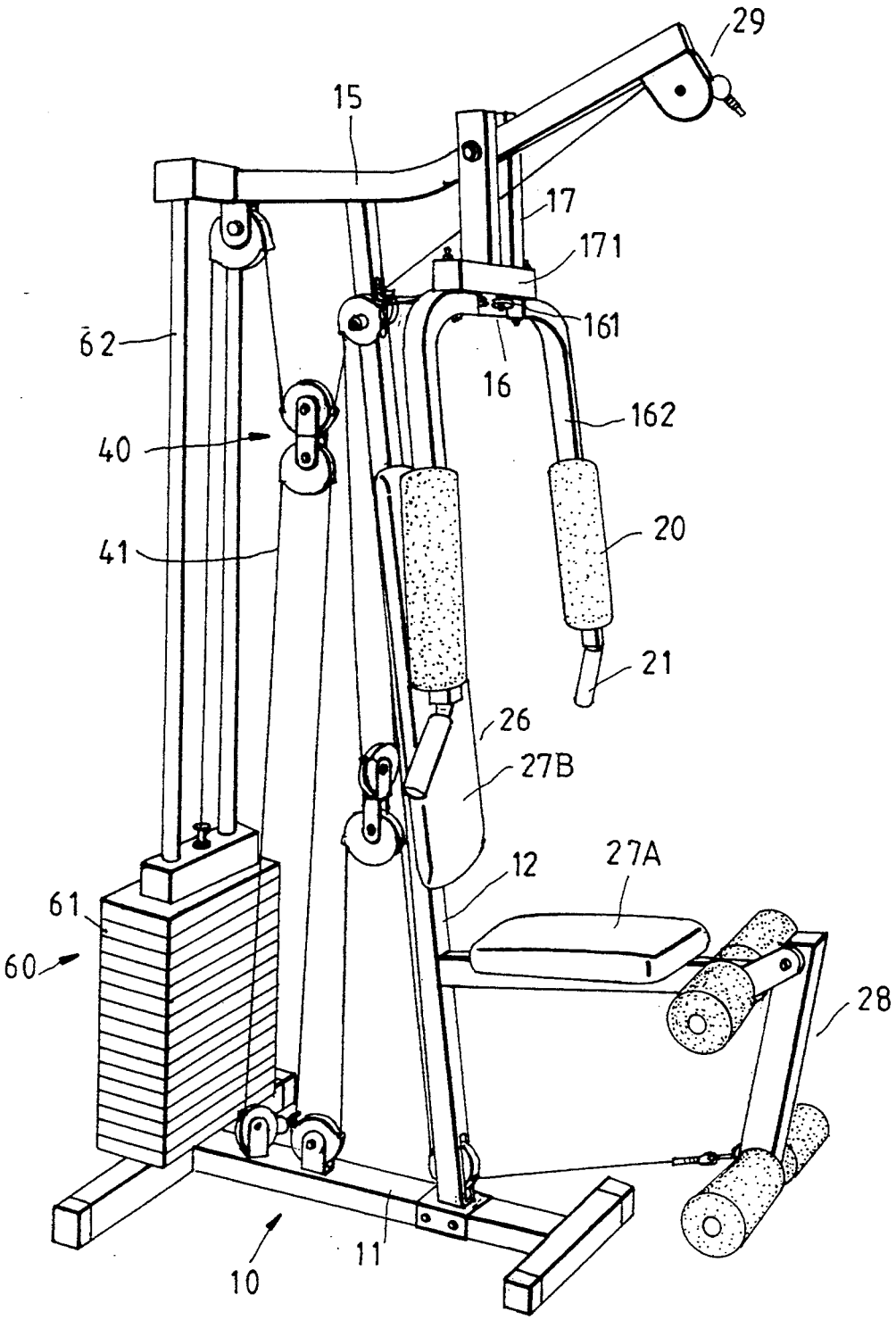
FIG. 1 shows a perspective view of a multipurpose gymnastic apparatus embodied in the present invention.
Figure 2:
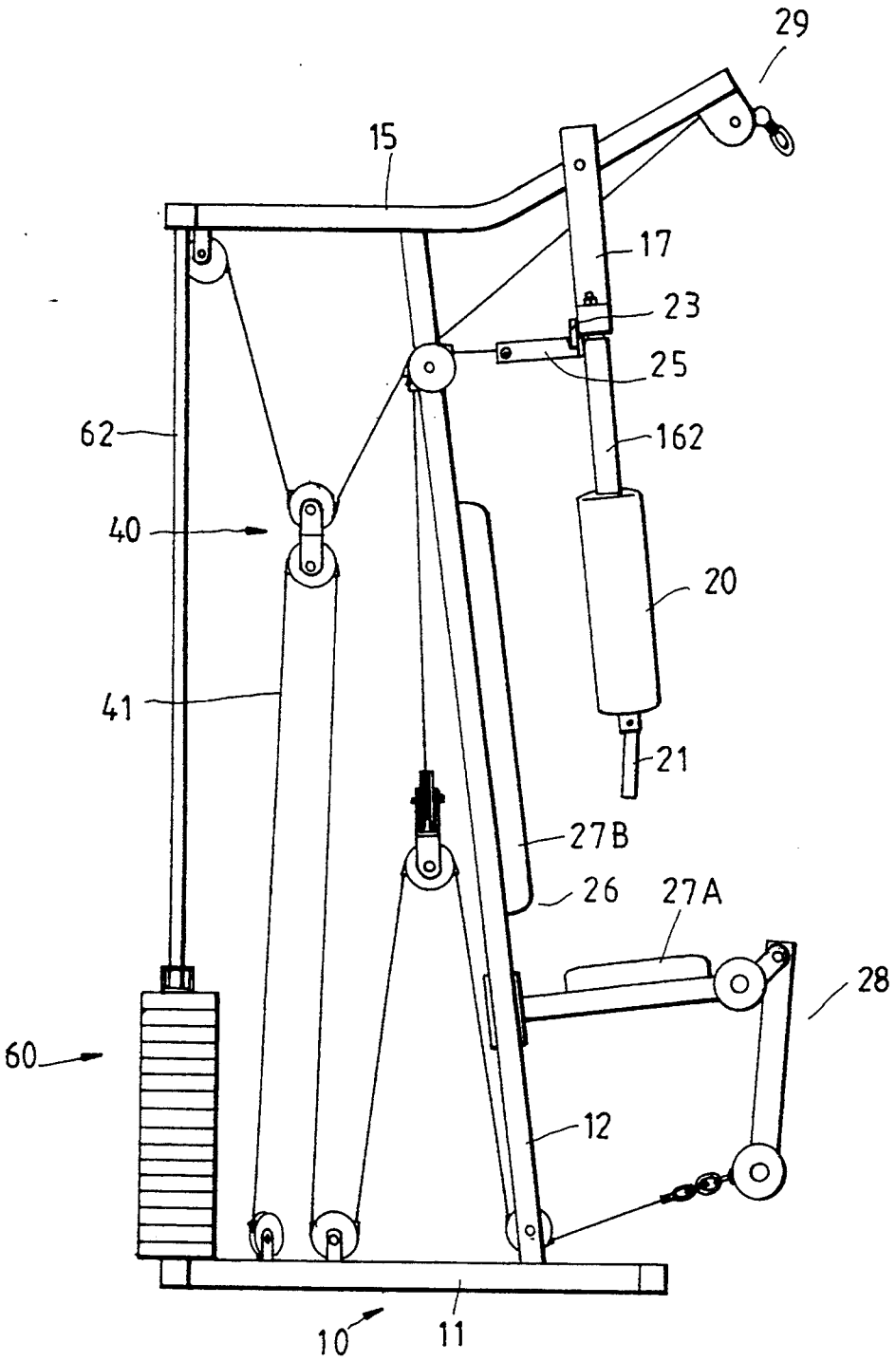
FIG. 2 shows a side elevational view of the multipurpose gymnastic apparatus of the present invention.
Figure 3:
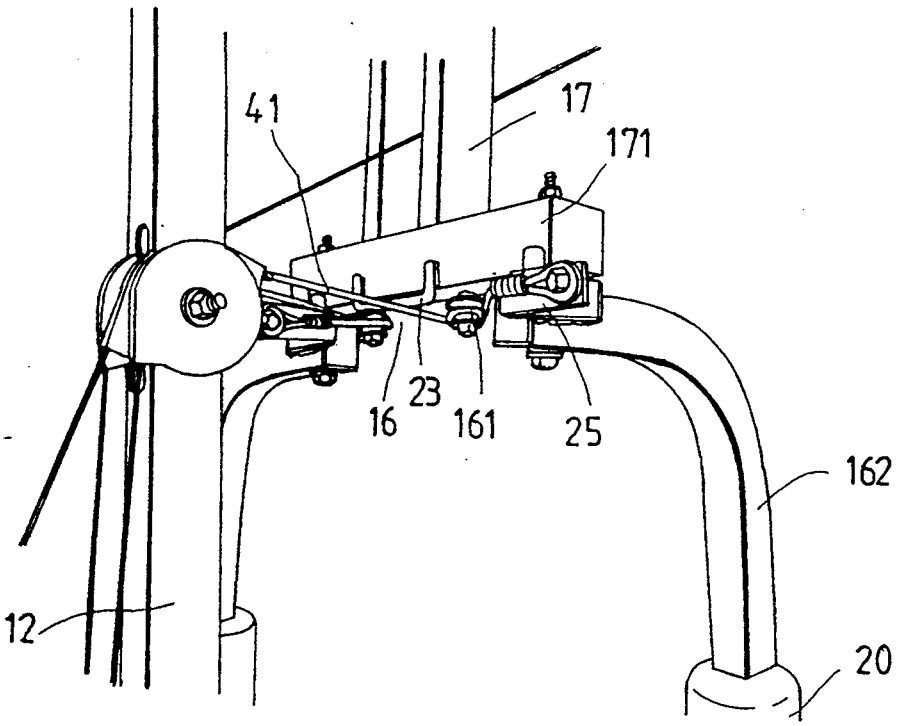
FIG. 3 is a schematic view of the structure of a switching device as taken from the left side of the multipurpose gymnastic apparatus of the present invention.
Figure 4:
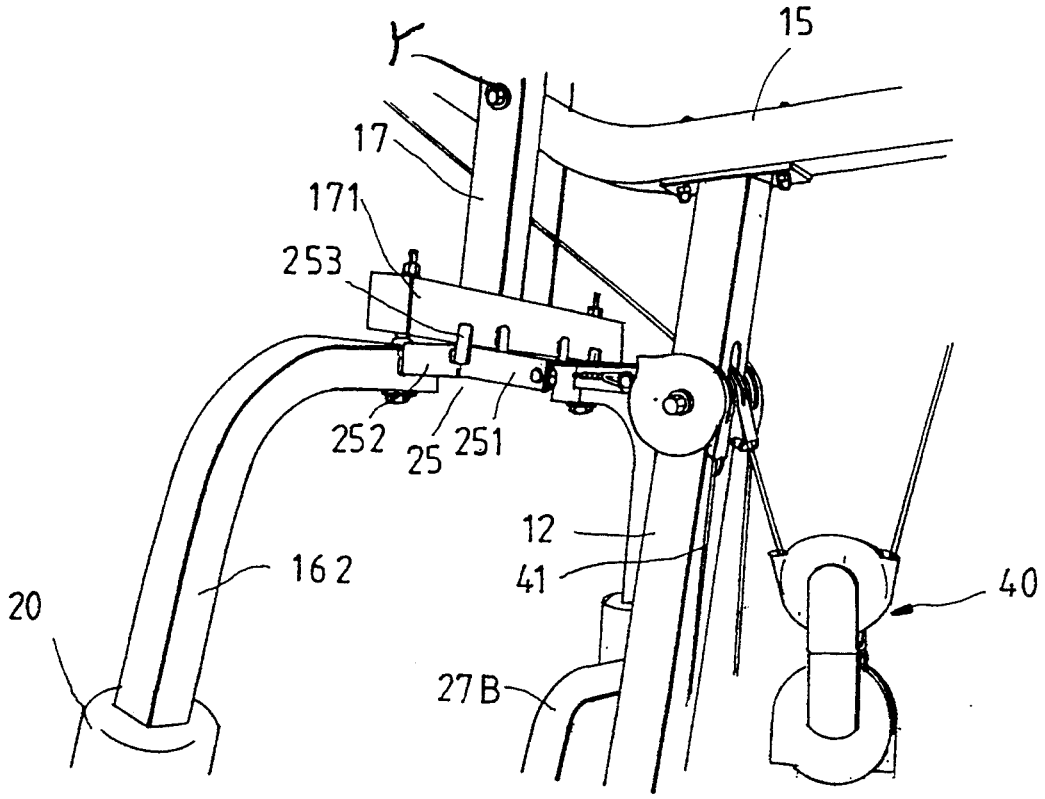
FIG. 4 is a schematic view of the structure of the switching device as taken from the right side of the multipurpose gymnastic apparatus of the present invention.
Figure 5:
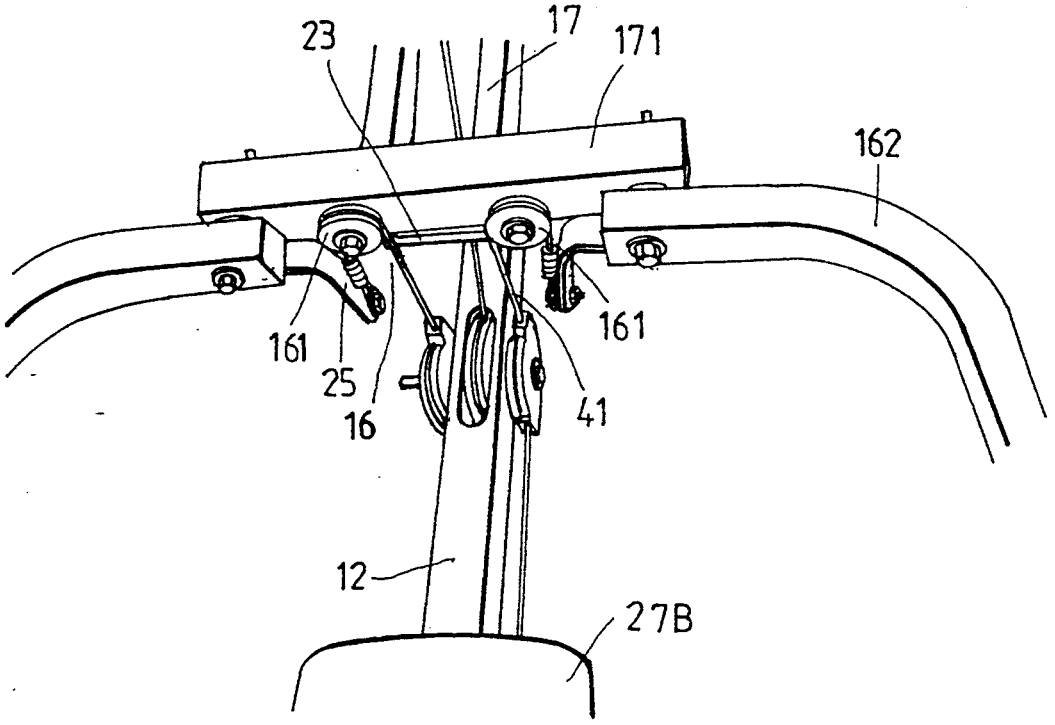
FIG. 5 is a schematic view of the structure of the switching device as taken from the bottom of the multipurpose gymnastic apparatus of the present invention.
Figure 6:
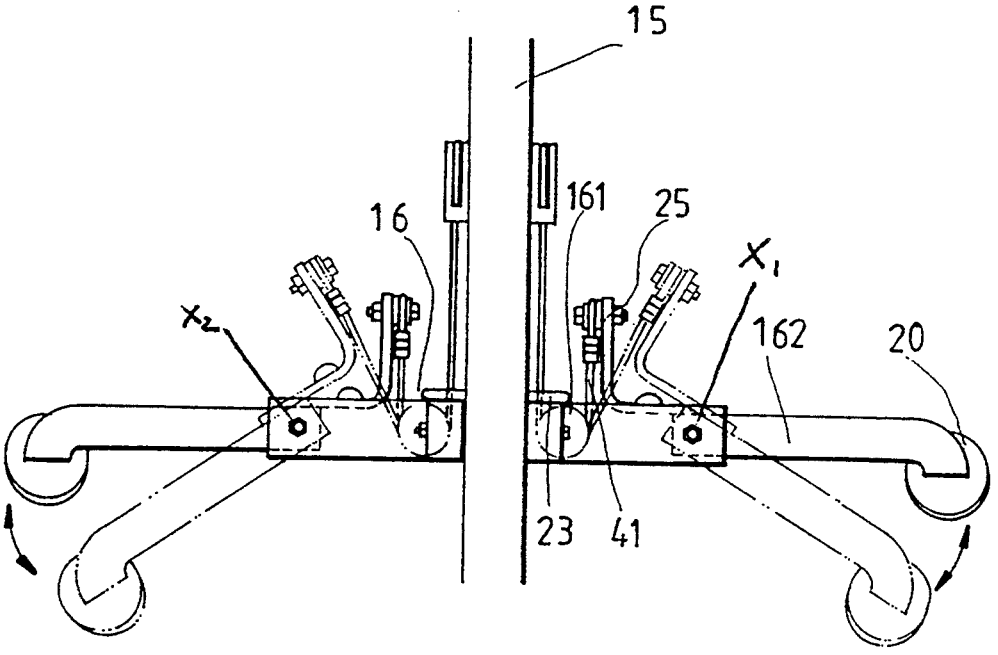
FIG. 6 is a schematic view of an arm building device in action as taken from the top of the multipurpose gymnastic apparatus of the present invention, showing that the switching device is used for a chest building exercise.
Figure 7:
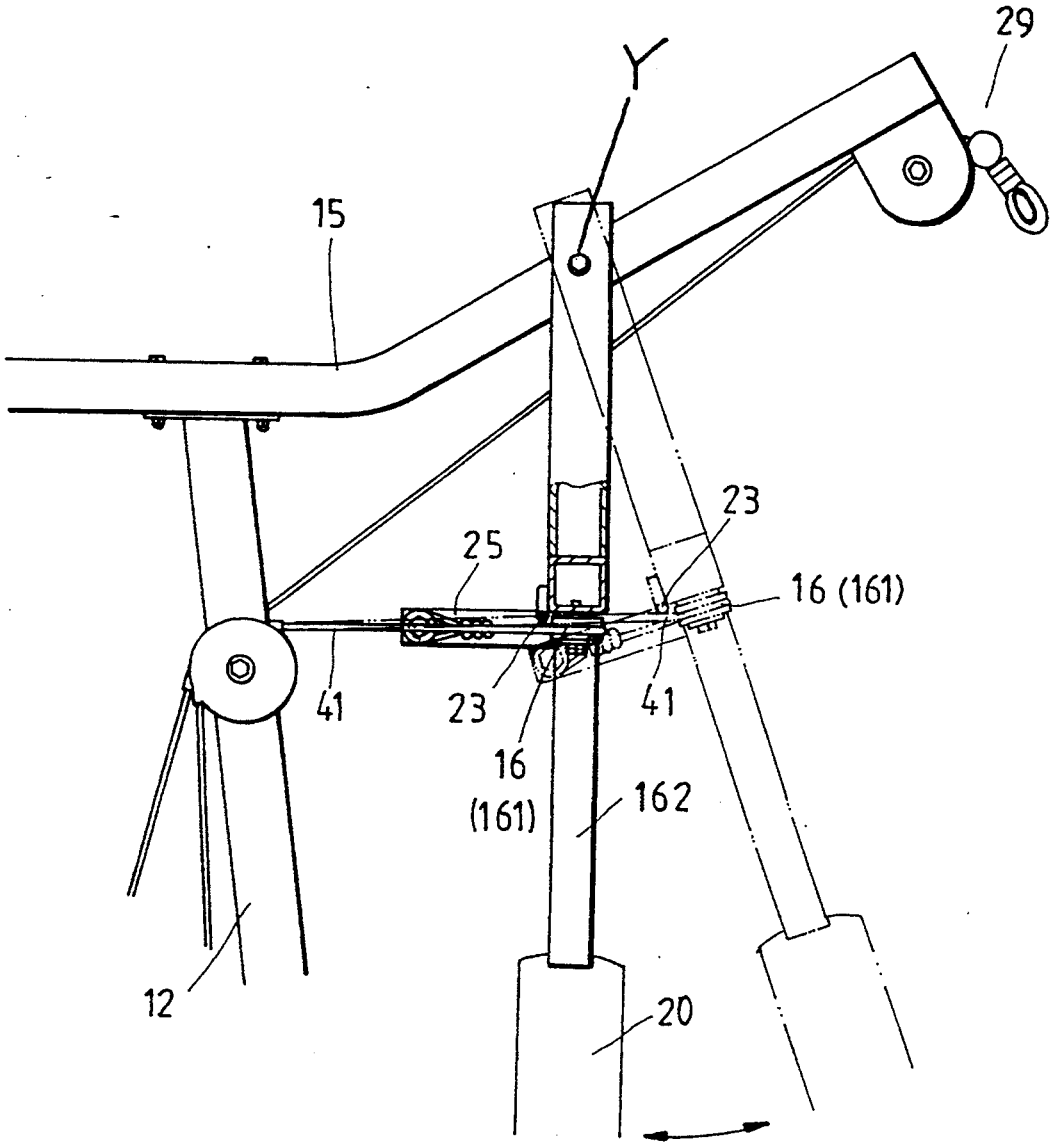
FIG. 7 is a schematic view of the arm building device in action as taken from the side of the multipurpose gymnastic apparatus of the present invention, showing that the switching device is used for the arm building exercise.

Referring to FIGS. 1–5, a multipurpose gymnastic apparatus embodied in the present invention is shown to comprise a frame unit 10, a pulley unit 40, and a load carrying unit 60.

The frame unit 10 comprises a ladder frame having a bottom beam 11, a bevel beam 12, and an upper beam 15 of an L-shaped construction fastened to the bevel beam 12. The rear end of the upper beam 15 is fastened to the top end of a strut 62 of the load carrying unit 60. A support frame 17 is pivoted at pivot point y to the upper beam 15. A dual-purpose switching device 16 is mounted to the lower end of the support frame 17 and is provided with two rotatable wheel fitting members 161, which are located respectively near both sides of the center of a bottom beam 171 of the support frame 17, and two arms 162 located respectively at both ends of the bottom beam 171 of the support frame 17. Each of the two arms 162 of an inverted L-shape has a short portion that is pivoted at pivot points $X_1$ and $X_2$ to a free end of the bottom beam 171 of the support frame 17. Both arms 162 can swivel in relation to each other. Each of the two arms 162 has a long portion provided with a protective casing 20 and a hand grip 21 whose axis and the arm 162 form a bevel which renders a better point of application. A protective rod 23 is mounted on the bottom beam 171 of the support frame 17 in such a manner that the protective rod 23 extends downwards to pass beyond the bottom beam 171. Two arresting pieces 25 of an L-shaped construction are respectively fastened to the ends of the two arms 162. The arresting piece body 251 adjacent to the wheel fitting member 161 is fastened to the end of the rope. The arresting piece 25 has another arresting piece body 252 provided with an arresting bar 253 for use in keeping the two arms 162 in an open position. A chair set 26 comprising a seat 27A and a back rest 27B is mounted on the bevel beam 12 under the switching device 16. A leg stretching device 28 is disposed in front of the seat 27A. A pulling device 29 is mounted on the front end of the upper beam 15.

The pulley unit 40 is composed of two groups mounted respectively under the upper beam 15 and over the bottom beam 11 and is turned by a rope 41 so as to transmit the power and to increase the mechanical advantage.

The load carrying unit 60 comprises a plurality of weights 61 stacked together such that the weights 61 can be raised and lowered by the rope 41. The desired number of the weights 61 can be determined by the user of the multipurpose gymnastic apparatus of the present invention.

The multipurpose gymnastic apparatus of the present invention is different from those of the prior art in that the invention is provided with two wheel fitting members 161, two arresting pieces 25, and a protective rod 23. Each of the two wheel fitting members 161 can be rotated by the rope 41. Each of the two arresting pieces 25 is fastened to the end of the arm 162 and is provided with an arresting piece body 251 that is fastened to the end of the rope 41. Each of the two arresting pieces 25 is further provided with another arresting piece body 252 provided thereon with an arresting bar 253 for keeping the two arms 162 in an open position. The protective rod 23 is mounted on the bottom beam 171 of the support frame 17 such that the protective rod 23 extends downwards to pass beyond the bottom beam 171 and remains a distance from the rope 41.

The multipurpose gymnastic apparatus of the present invention has advantages over the multipurpose gymnastic apparatus of the prior art, which are described hereinafter.

When a user of the multipurpose gymnastic apparatus wishes to do a chest building exercise, he or she may use his or her arms to push the protective casings 20 of the arms 162 so as to actuate the rope 41 to raise the weights 61 of the load carrying unit 60. When the user wants to do an arm building exercise, he or she does not have to do any mechanical adjustment of the multipurpose gymnastic apparatus of the present invention. All he or she has to do is to hold the hand grips 21 to push the support frame 17 upwards so as to cause the protective rods 23 to press against the rope 41. It must be noted here that the protective rods 23 must be caused to press against the rope 41 for the purpose of preventing the wheels of the wheel fitting members 161 from deforming so as to prolong the service life span of the wheels. In addition, the hand grips 21 of the present invention are so arranged that the axis of each of the two hand grips 21 and each of the two arms 162 form a bevel, which permits the point of application of an arm building action to be stabilized and which prevents the arm building exercise from interfering mechanically from the chest building exercise. In short, the multipurpose gymnastic apparatus of the present invention permits a user to do the arm building exercise and the chest building exercise without having to make manually any mechanical adjustment of the apparatus.

What is claimed is:

1. A multipurpose gymnastic apparatus comprising:

a frame unit (10) having a bottom base (11), a level beam (12) and an upper beam (15) joined together to form said frame unit (10);

a chair set (26) mounted on said level beam (15);

a leg stretching means (28) mounted in front of a seat (27A) of said chair set (26);

a dual purpose pushing and rotating means (16) mounted on said upper beam (15) above said chair set for permitting a user to switch from a chest building exercise to an arm building exercise;

a pulley unit (40) having two groups mounted respectively at the upper and the lower portions of said frame unit;

said pulley unit (40) having a plurality of ropes (41) running through said pulley unit (40) and having free ends respectively connected to said pushing and rotating means (16) and said leg stretching means (28);

load carrying means (60) engaged to said ropes for lifting and lowering a selected load when said user is exercising, wherein said dual-purpose pushing and rotating means (16) comprises:

a support frame (17) rotatably pivoted at a first end on said upper beam (15);

a bottom beam (171) transversely fixed to a second end of said support frame (17);

each of a pair L-shaped arms (162) having a first end respectively rotatably pivoted to opposite ends of said bottom beam (171) and a second end having a protective casing (20) and a hand grip (21) extending at an angle;

a protective rod (23) mounted on and extending down from said bottom beam (171);

each of two wheel fitting members (161) rotatably mounted on said bottom beam (171);

each of two arresting pieces having a first body and a second body;

said first body of each of said two arresting pieces joined to said first end of each of said two L-shaped arms;

each of two ropes of said plurality of ropes connected to said pushing and rotating means engaged around one of said two wheel fitting members and to an end of said second body of said two arresting pieces;

an arresting bar mounted on each said first body and engaging said bottom beam to limit rotation of said pair of L-shaped arms;

wherein when said user engages and pushes said each said protective casing (20) to perform said chest building exercise said pair of L-shaped arms rotate on said bottom beam to pull said each of said two ropes around said two wheel fitting members and lift said selected load and, wherein when said user grasps and pushes each said hand grip (21) to perform said arm building exercise said support frame (17) rotates on said upper beam and said protective rod engages each of said two ropes to preclude rotation of said two ropes around said two wheel fitting members.

2. The multipurpose gymnastic apparatus according to claim 1 wherein, the plane of rotation of said support frame (17) is substantially perpendicular to the plane of rotation of said pair of L-shaped arms, and the angle of each said hand grip (21) is such that when said user performs said arm building exercise only said pair of L-shaped arms rotate.

* * * * *